US005169297A

United States Patent [19]

Mizuno et al.

[11] Patent Number: 5,169,297

[45] Date of Patent: Dec. 8, 1992

[54] CERAMIC TURBO CHARGER ROTOR

[75] Inventors: Takeyuki Mizuno, Toyohashi; Hiroyuki Kawase, Nagoya; Seiichi Asami, Okazaki; Kenji Adachi, Nagoya, all of Japan

[73] Assignee: NGK Insulators, Ltd., Japan

[21] Appl. No.: 533,391

[22] Filed: Jun. 5, 1990

[30] Foreign Application Priority Data

Jun. 6, 1989 [JP] Japan ..... 1-142168
Mar. 8, 1990 [JP] Japan ..... 2-55027

[51] Int. Cl.[5] ..... F04B 17/00
[52] U.S. Cl. ..... 417/407; 416/244 A
[58] Field of Search ..... 417/407, 406, 405, 409; 384/493, 900, 277, 471; 416/241 B, 244 A

[56] References Cited

U.S. PATENT DOCUMENTS 3,612,628 10/1971 Steele ..... 416/241 B
4,063,850 12/1977 Hueber et al. ..... 416/241 B
4,340,317 7/1982 Heitmann et al. ..... 416/244 A
4,652,219 3/1987 McEachern, Jr. et al. ..... 417/407
4,704,074 11/1987 Kawamoto et al. .
4,749,334 6/1988 Byrne ..... 416/241 B
4,798,523 1/1989 Glaser et al. ..... 417/407
4,969,805 11/1990 Romeo ..... 417/407
4,984,927 1/1991 Kojima et al. ..... 416/241 B
4,991,991 2/1991 Ito et al. ..... 416/241 B

FOREIGN PATENT DOCUMENTS 952756 11/1986 Fed. Rep. of Germany .

*Primary Examiner*—Richard A. Bertsch
*Assistant Examiner*—Timothy S. Thorpe
*Attorney, Agent, or Firm*—Parkhurst, Wendel & Rossi

[57] ABSTRACT

A ceramic turbo charger rotor having a bearing structure in which an inner race of an angular ball bearing and a spacer are assembled to a journal shaft as one unit in such a manner that one end of the spacer is assembled to a turbine-side connecting portion of the journal shaft by a pressure inserting manner and the other end of the spacer is assembled to a compressor-side connecting portion of the journal shaft by a clearance fitting manner. Therefore, the deviation between a center axis and a rotational axis of the rotor caused by the pressure insertion of the spacer is released at the compressor side and the amount of the unbalance before correcting of the rotor is remarkably reduced.

3 Claims, 2 Drawing Sheets

CERAMIC TURBO CHARGER ROTOR

BACKGROUND OF THE INVENTION

Field of the Invention and Related Statement

The present invention relates to a ceramic turbo charger rotor having a ball bearing structure, particularly to a ceramic turbo charger rotor in which an angular ball bearing and a spacer are assembled to an outer surface of a journal shaft of the ceramic turbo charger rotor as one unit.

The ceramic turbo charger rotor in which a ceramic turbine rotor and a metal compressor rotor are connected by a metal shaft is generally used by being assembled to a bearing housing which is supported by a floating metal or a ball bearing.

The balance of such ceramic turbo charger rotor is corrected in such a manner that the unbalance of the ceramic turbine rotor is firstly corrected when the metal shaft is assembled to the ceramic turbine rotor, and then the balance of the turbo charger rotor as a whole is corrected when the metal compressor rotor is assembled to the metal shaft by means of a nut.

FIG. 1 is a schematic view showing a ceramic turbo charger rotor having a ball bearing structure. The ceramic turbo charger rotor 11 comprises a ceramic turbine rotor 12 and a metal shaft 13 comprising a journal shaft 13*a*, and an inner race 14 and a spacer 15 assembled to an outer surface of the journal shaft 13*a* as one unit. Hitherto, two ways have been suggested for assembling the spacer 15 to connecting portions 13*b* and 13*c* of the journal shaft 13*a*: pressure inserting and clearance fitting. When the spacer 15 is assembled to the connecting portions 13*b* and 13*c* of the journal shaft 13*a* by a pressure inserting manner, the balance of the turbo charger rotor 11 is corrected after the inner race 14 and the spacer 15 have been assembled to the journal shaft 13, as shown in FIG. 1. On the other hand, when the spacer 15 is assembled to the connecting portions 13*b* and 13*c* of the journal shaft 13 by a clearance fitting manner, the balance of the rotor 11 is corrected before assembling the inner race 14 and the spacer 15 to the journal shaft 13.

However, when the spacer 15 is assembled to the journal shaft 13 by a pressure inserting manner, a deviation between a center axis and a rotation axis of the ceramic turbo charger rotor occurs, and therefore the amount of unbalance of the ceramic turbo charger rotor is apt to become large due to the deviation. Thus a lot of working time is necessary to correct the unbalance of the ceramic turbo charge rotor, and the balance of the ceramic turbo charger rotor to which the metal compressor rotor has been assembled cannot be maintained under the influence of the deviation.

further, when the pacer 15 is assembled to the journal shaft 13 by a clearance fitting manner, precise processing and inspecting are required to provide a clearance in the spacer 15, because the clearance between the journal shaft 13 and the spacer 15 should be processed to about several μm or less.

SUMMARY OF THE INVENTION

The present invention has for its object to provide a ceramic turbo charger rotor in which the amount of the unbalance of the ceramic turbo charger rotor is little when the inner race of the angular ball bearing and the spacer are assembled to the metal journal shaft as one unit, and the unbalance can be easily corrected, and further a high precision processing step is not necessary to make the clearance of the spacer.

In order to carry out the object, the ceramic turbo charger rotor comprises:

a ceramic turbine rotor;

a metal shaft comprising a journal shaft being assembled to said ceramic turbine rotor;

an inner race of an angular ball bearing; and a spacer.

The inner race and spacer are assembled to an outer surface of the journal shaft as one unit. The journal shaft comprises connecting portions at both a turbine side and a compressor side thereof. One end of the spacer is assembled to the turbine-side connecting portion in a pressure inserting manner and the other end of the spacer is assembled to the compressor-side connecting portion in a clearance fitting manner.

According to the invention, since one end of the spacer is assembled to the turbine-side connecting portion of the journal shaft in a pressure inserting manner and the other end of the spacer is assembled to the compressor-side connecting portion of the journal shaft in a clearance fitting manner, the deviation between the center axis and a rotation axis of the ceramic turbo charger rotor, which deviation is caused by the pressure insertion of the spacer to the journal shaft, is released when the other end of the spacer is assembled to the compressor-side connecting portion of the journal shaft in a clearance fitting manner. Therefore, the amount of the unbalance of the ceramic turbo charger rotor is reduced, and thus the working time for adjusting the unbalance of the ceramic turbo charger rotor can be decreased. Further, the variation of the unbalance, which is caused when the ceramic turbo charger rotor, to which a metal compressor rotor has been assembled, is rotated due to the deviation, can be effectively prevented.

Furthermore, according to the invention, a high precision processing step is not required to make the clearance of the spacer.

The present invention has for another object to provide a ceramic turbo charger rotor which satisfies the following conditions:

$$0.25 \leqq L/D \leqq 1.5$$

wherein: reference D represents a diameter of the turbine-side connecting portion of the journal shaft, and reference L represents a pressure insertion length of the spacer to the turbine-side connecting portion of the journal shaft.

When the ceramic turbo charger rotor satisfies the above mentioned condition, the deviation caused by the pressure insertion of the spacer becomes smaller and the amount of the unbalance of the ceramic turbo charger rotor is reduced even further.

DETAILED DESCRIPTION OF THE PREFERRED EMBODIMENT

Figure 2:
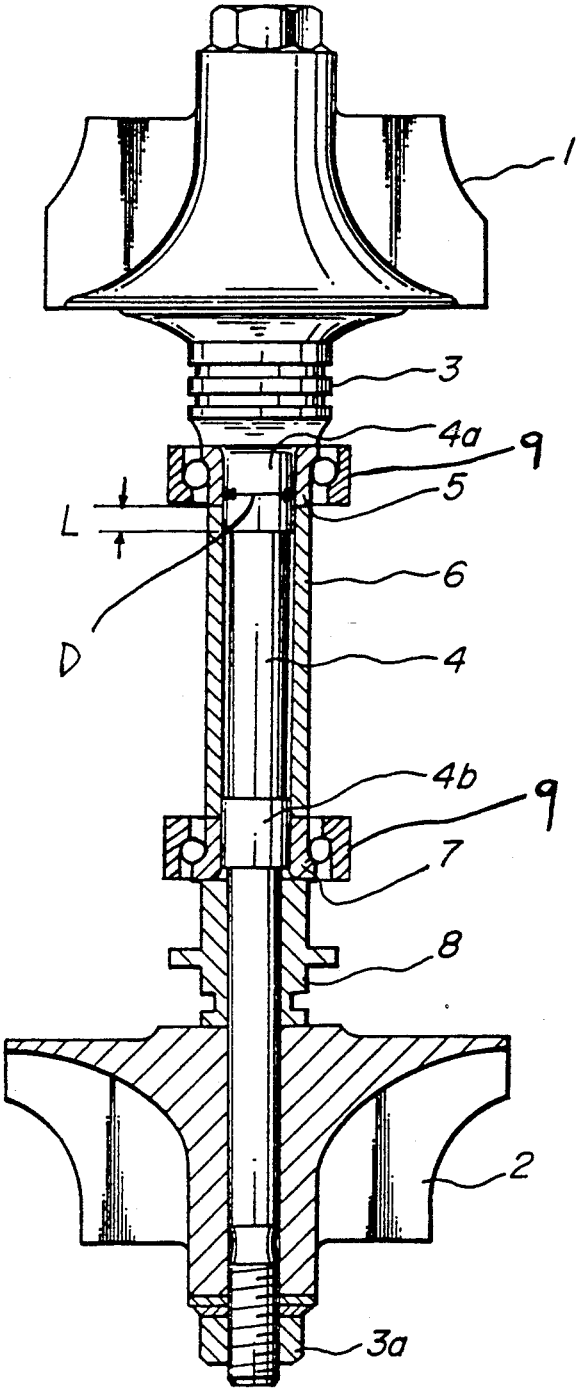
FIG. 2 is a schematic view showing the ceramic turbo charger rotor shown in FIG. 1 to which a metal compressor rotor is assembled.

FIG. 2 is a schematic view showing an embodiment of a ceramic turbo charger rotor according to the present invention. In FIG. 2, reference numeral 1 denotes a ceramic turbine rotor; 2 is a metal compressor rotor; 3 is a metal shaft which connects the ceramic turbine rotor and the metal compressor rotor, and the metal shaft 3 comprises a journal shaft 4 having connecting portions 4*a* at a turbine side and 4*b* at a compressor side; 3*a* is a nut for assembling the metal compressor rotor 2 to the metal shaft 3; 5 is an inner race of an angular ball bearing which is assembled to the outer surface of the journal shaft 4 at a turbine side by a pressure inserting manner or a clearance fitting manner; 6 is a spacer, the top end of which is assembled to the turbine-side connecting portion 4*a* of the journal shaft by a pressure inserting manner and the bottom end of which is assembled to the compressor-side connecting portion 4*b* by a clearance fitting manner; 7 is an inner race of an angular ball bearing which is assembled to the compressor-side of the outer surface of the journal shaft 4 by a pressure inserting manner; 8 is a thrust spacer which is arranged between the inner race 7 and the metal compressor rotor 2; 9 is an angular ball bearing; and D is the diameter of the turbine-side connecting portion 4*a*. It should be noted that the inner race 5, the spacer 6 and the inner race 7 are assembled to the journal shaft 4 so as to be arranged between the ceramic turbine rotor 1 and the metal compressor rotor 2 via the thrust spacer 8, and these assemblies are fixed to the metal shaft 3 by means of the nut 3*a*.

In this embodiment, the diameter of the journal shaft 4 is made large at both ends, i.e., connecting portions 4*a* and 4*b*, in order to facilitate assembling the inner races 5 and 7 and the spacer 6.

It should be noted that the pressure insertion clearances vary in accordance with the diameter of the journal shaft 4, and therefore the pressure insertion clearances are not particularly limited.

Experiment 1

Figure 1:
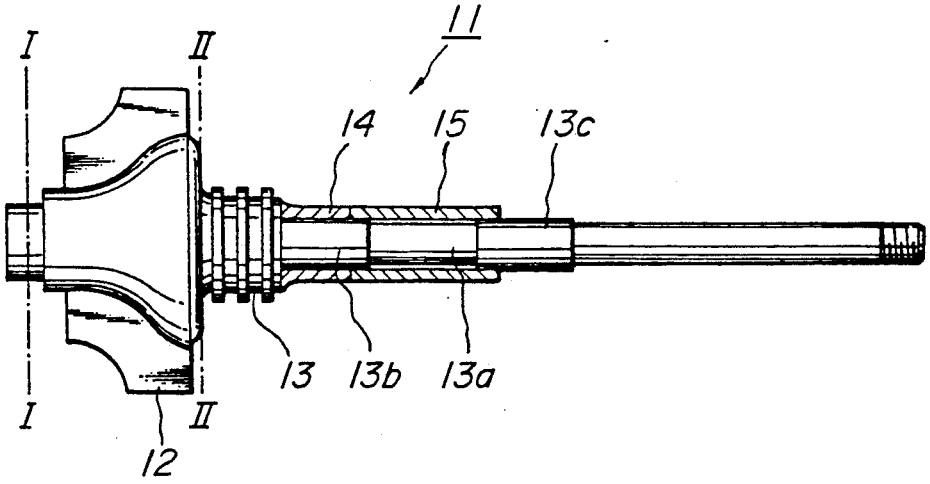
FIG. 1 is a schematic view showing an embodiment of a ceramic turbo charger rotor according to the invention.

Seven ceramic turbo charger rotors (sample No. 1–7) made by $Si_3N_4$ were prepared. A diameter of the turbine blade of each rotor is 55 mm and a diameter of the connecting portions of the metal shaft is 8 mm. The top end of the spacer 6 was assembled to the turbine-side connecting portion 4*a* of the journal shaft 4 by a pressure inserting manner and the bottom end of the spacer 6 was assembled to the compressor-side connecting portion 4*b* of the journal shaft 4 by a clearance fitting manner. However, the pressure inserting clearances of the inner race of angular ball bearing and the spacer 6 are varied in accordance with the numerical data shown in Table 1, and the pressure insertion length L of the spacer 6 proximate the turbine-side connecting portion of the journal shaft 4 was 3 mm (L/D=0.375). On the other hand, seven conventional ceramic turbo charger rotors (sample No. 8–14), which are the same as the rotors according to the invention mentioned above in material and size, but both the ends of the spacer 6 were assembled to the connecting portions 4*a*, 4*b* of the journal shaft 4 by a clearance fitting manner were prepared. Then the amount of the unbalance before correcting was measured concerning each sample on the correcting surfaces I and II. The correcting surfaces I and II are shown in FIG. 1 by lines I—I and II—II.

TABLE 1

| | | Pressure insertion clearance* (μm) | | | Amount of unbalance before correcting | |
|---|---|---|---|---|---|---|
| | | Turbine side | | Compressor side | | |
| Sample No. | | inner race | Spacer | Spacer | Correcting surface I (gr · mm) | Correcting surface II (gr · mm) |
| Products according to the present invention | 1 | −2 | 8 | −25 | 0.3 | 0.9 |
| | 2 | −2 | 8 | −10 | 0.4 | 1.2 |
| | 3 | 5 | 6 | −8 | 0.2 | 0.5 |
| | 4 | −2 | 2 | −3 | 0.3 | 1.0 |
| | 5 | 6 | 12 | −15 | 0.5 | 1.4 |
| | 6 | 7 | 14 | −50 | 0.3 | 1.2 |
| | 7 | 9 | 14 | −6 | 0.4 | 1.2 |
| Conventional products | 8 | 9 | 8 | 6 | 1.2 | 4.1 |
| | 9 | −2 | 8 | 7 | 0.5 | 2.0 |
| | 10 | 5 | 6 | 9 | 0.8 | 1.9 |
| | 11 | −2 | 2 | 3 | 1.4 | 3.8 |
| | 12 | 6 | 12 | 14 | 1.1 | 3.6 |
| | 13 | 7 | 14 | 13 | 1.7 | 6.1 |
| | 14 | 9 | 4 | 3 | 0.7 | 2.3 |

*pressure inserting clearance of tubine side = outer diameter of turbine side connecting portion − inner diameter of ball bearing inner race
pressure inserting clearance of turbine side = outer diameter of turbine side connecting portion − inner diameter of spacer
pressure inserting clearance of compressor side = outer diameter of compressor side connecting portion − inner diameter of spacer It is clear from Table 1 that the amounts of the unbalance of the correcting surfaces I and II of sample number 1–7 (rotors according to the present invention) are improved in comparison with those of the rotors of sample numbers 8–14 (conventional rotors).

Experiment 2

A ceramic turbo charger rotor is prepared the same as the rotors of sample numbers 1–7 in Table 1 in material and size, except the pressure insertion clearance of the ball bearing inner race at the compressor side is arranged to be −2 μm, the pressure insertion clearance of the spacer at the turbine side is arranged to be −6 μm, and the pressure insertion length L of the spacer to the turbine-side connecting portion 4*a* is arranged to be 5 mm (L/D=0.625). After correcting the unbalance of this ceramic turbo charger rotor, the rotor was assembled to an engine and rotated at a rotational speed of 130,000 r.p.m. for 15 minutes at a temperature of 900° C., and thereafter 80,000 r.p.m. for 15 minutes at 900° C. This cycle was repeated 300 times. However, failure of the ceramic turbo charger rotor did not occur. Further, a vibration detector was set at an oil exit of a turbo charger center housing to detect the vibration of the engine. However, the vibration was generated in synchronization with the rotation of the ceramic turbo charger rotor and thus was stabilized.

This test proves that the rotating performance of the ceramic turbo charger rotor according to the invention is the same as or better than that of the conventional rotors.

Experiment 3

In order to determine a range pressure of insertion length L preferred to minimize the unbalance of the rotor before correcting, the relation between the diameter D of the turbine-side connecting portion 4*a* of the journal shaft and the pressure insertion length L of the spacer 6 to the turbine-side pressure insertion length was examined concerning the ceramic turbo charger rotors according to the invention.

That is to say, ten turbo charger rotors (sample Nos. 15–24) made by $Si_3N_4$ were prepared. The diameter of the blade of each rotor is arranged to be 55 mm and the diameter of the turbine-side connecting portion of the journal shaft thereof 8 mm. The top end of the spacer is assembled to the turbine-side connecting portion of the journal shaft by a pressure inserting manner and the bottom end of the spacer is assembled to the compressor-side connecting portion of the journal shaft by a clearance fitting manner. However, the pressure insertion clearance of the spacer at the turbine side, the diameter D of the connecting portions of the journal shaft, and the pressure insertion length L of the spacer to the turbine-side connecting portion of the journal shaft were varied according to the data shown in Table 2. Then, concerning each sample (sample Nos. 15–34), the amount of the unbalance was measured on the correcting surfaces I and II in the same manner as in Experiment 1.

Table 2 proves that the amount of the unbalance before correcting becomes small in the range of 0.25–1.5 of L/D and that it is impossible to make the amount of the unbalance before correcting small only by making the pressure insertion clearance large.

Experiment 4

The ceramic turbo charger rotor according to the present invention was prepared in which the diameter of the connecting portions of the journal shaft is arranged to be 8 mmϕ, pressure insertion length of the spacer to the turbine-side connecting portion is arranged to be 4 mm (L/D=0.5), and the amount of the unbalance before correcting is arranged to be 0.3 gr·mm at the surface and 0.5 gr·mm at the surface to II. The unbalance was corrected at a predetermined value. Thereafter the rotor was assembled in an engine, and the engine was rotated at a rotational speed of 125,000 r.p.m. for 20 minutes at a temperature of 880° C. and 90,000 r.p.m. for 10 minutes at 880° C. and then the engine was stopped for 5 minutes. This cycle was repeated 200 times. However, failure of the rotor did not occur.

As in Experiment 2, a vibration detector was set on a surface of a turbo charger center housing to detect the vibration of the engine. The vibration was generated in synchronization with the rotation of the turbo charger rotor and thus was stabilized.

As clear from the explanation of the experiments, in the ceramic turbo charger rotor having a ball bearing structure according to the present invention, since the top end of the spacer is assembled to the turbine-side connecting portion of the journal shaft in a pressure inserting manner and the bottom end of the spacer is assembled to the compressor-side connecting portion of the journal shaft in a clearance fitting manner, the amount of the unbalance before correcting of the rotor is decreased. Therefore, the working time for balancing the rotor can be shortened and the variation of the unbalance caused by the deviation between the rotating shaft and the center shaft of the rotor can be effectively prevented. Furthermore, since the processing accuracy of the spacer of the rotor is no longer so critical, the processing of the spacer becomes easier.

TABLE 2

| Sample No. | | Diameter of correcting portions D (mm) | Pressure insertion lengths of spacer L (mm) | L/D | Pressure insertion clearance of spacer (μm) | Amount of unbalance before correcting (gr · mm) Surface I | Surface II |
|---|---|---|---|---|---|---|---|
| Products A | 15 | 8 | 2.0 | 0.25 | 8 | 0.3 | 0.5 |
| | 16 | 8 | 4.0 | 0.50 | 12 | 0.3 | 0.6 |
| | 17 | 8 | 8.0 | 1.00 | 6 | 0.3 | 0.4 |
| | 18 | 8 | 12.0 | 1.50 | 14 | 0.2 | 0.2 |
| | 19 | 6 | 1.5 | 0.25 | 5 | 0.1 | 0.2 |
| | 20 | 6 | 7.8 | 1.3 | 8 | 0.3 | 0.5 |
| | 21 | 10 | 6.0 | 0.6 | 10 | 0.4 | 0.6 |
| | 22 | 10 | 14.0 | 1.4 | 12 | 0.2 | 0.4 |
| | 23 | 12 | 9.6 | 0.8 | 11 | 0.3 | 0.4 |
| | 24 | 12 | 18.0 | 1.5 | 13 | 0.4 | 0.3 |
| Products B | 25 | 8 | 14.4 | 1.8 | 12 | 0.7 | 1.1 |
| | 26 | 8 | 0.8 | 0.1 | 3 | 0.7 | 1.1 |
| | 27 | 8 | 1.2 | 0.15 | 25 | 0.7 | 1.2 |
| | 28 | 8 | 1.2 | 0.15 | 40 | 1.2 | 3.2 |
| | 29 | 6 | 0.9 | 0.15 | 8 | 0.7 | 1.5 |
| | 30 | 6 | 12.0 | 2.0 | 8 | 0.5 | 1.0 |
| | 31 | 10 | 6.0 | 0.6 | 10 | 0.4 | 0.6 |
| | 32 | 10 | 14.0 | 1.4 | 12 | 0.2 | 0.4 |
| | 33 | 12 | 9.6 | 0.8 | 11 | 0.3 | 0.4 |
| | 34 | 12 | 18.0 | 1.5 | 13 | 0.4 | 0.3 |

Moreover, when the ratio of the diameter of the turbine-side connecting portion of the journal shaft D and the pressure insertion length of the spacer to the turbine-side connecting portion of the journal shaft L satisfies the condition of $0.25 \leqq L/D \leqq 1.5$, it is possible to reduce even further the amount of the unbalance before correcting the ceramic turbo charger rotor. Accordingly, in such a rotor the working time for correcting the unbalance can be remarkably shortened.

What is claimed is:

1. A ceramic turbo charger rotor comprising:

a ceramic turbine rotor;

a metal shaft, comprising a journal shaft, assembled to said ceramic turbine rotor;

an inner race of an angular ball bearing; and a spacer;

wherein said inner race and said spacer are assembled to an outer surface of said journal shaft as one unit; said journal shaft comprises connecting portions at both a turbine side and compressor side thereof; and one end of said spacer is assembled to said turbine-side connecting portion of said journal shaft by a pressure inserting manner and the other end of said spacer is assembled to said compressor-side connecting portion of said journal shaft by a clearance fitting manner.

2. A ceramic turbo charger rotor according to claim 1, further comprising:

a metal compressor rotor; and a thrust spacer;

said wherein metal compressor rotor is assembled to said metal shaft via said thrust spacer.

3. A ceramic turbo charger rotor according to claim 1; wherein:

a ratio of a diameter of said turbine-side connecting portion of the journal shaft and a pressure insertion length of said spacer to the turbine-side connecting portion of the journal shaft satisfies the following condition:

$$0.25 \leqq L/D \leqq 1.5$$

wherein: D represents a diameter of the turbine-side connecting portion of the journal shaft, and L represents a pressure insertion length of the spacer to the turbine-side connecting portion of the journal shaft.

* * * * *